US008112009B2

(12) United States Patent
Barton

(10) Patent No.: US 8,112,009 B2
(45) Date of Patent: Feb. 7, 2012

(54) ELECTROPHOTOGRAPHIC APPARATUS HAVING FUSER TEMPERATURE CONTROL AND CORRESPONDING METHODS

(75) Inventor: Augusto E. Barton, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 621 days.

(21) Appl. No.: 12/253,946

(22) Filed: Oct. 18, 2008

(65) Prior Publication Data

US 2010/0098448 A1 Apr. 22, 2010

(51) Int. Cl.
*G03G 15/20* (2006.01)

(52) U.S. Cl. ..... 399/69; 399/341

(58) Field of Classification Search ..... 399/69 FS, 399/341

See application file for complete search history.

(56) References Cited

U.S. PATENT DOCUMENTS

| | | | | |
|---|---|---|---|---|
| 5,678,133 | A | 10/1997 | Siegel | |
| 5,748,221 | A | 5/1998 | Castelli et al. | |
| 5,839,016 | A | 11/1998 | Folkins et al. | |
| 6,085,050 | A | 7/2000 | Rowe et al. | |
| 6,101,345 | A | 8/2000 | Van Goethem et al. | |
| 6,389,241 | B1 | 5/2002 | Cernusak et al. | |
| 2007/0086803 | A1 * | 4/2007 | Kimura et al. | 399/69 |
| 2007/0264059 | A1 * | 11/2007 | Maeda et al. | 399/320 |

* cited by examiner

*Primary Examiner* — David Gray
*Assistant Examiner* — Ruth Labombard
(74) *Attorney, Agent, or Firm* — Ronald E. Prass, Jr.; Prass LLP

(57) ABSTRACT

Disclosed are a method of forming images on media in an electrophotographic apparatus, and corresponding electrophotographic apparatus. The method includes measuring a temperature of the media with a sensor after the toner particles have been fused to the media, and controlling a temperature of the heater device with a controller based on the measured temperature of the media, wherein the temperature is controlled to obtain a desired gloss level for subsequent media to be fused.

18 Claims, 10 Drawing Sheets

ELECTROPHOTOGRAPHIC APPARATUS HAVING FUSER TEMPERATURE CONTROL AND CORRESPONDING METHODS

BACKGROUND

Disclosed are an electrophotographic apparatus having fuser temperature control and corresponding methods.

In a typical electrophotographic or electrostatographic printing process, a photoconductive member is charged to a substantially uniform potential so as to sensitize the surface thereof. The charged portion of the photoconductive member is exposed to selectively dissipate the charges thereon in the irradiated areas. This records an electrostatic latent image on the photoconductive member. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules either to a donor roller or to a latent image on the photoconductive member. The toner attracted to a donor roller is then deposited as latent electrostatic images on a charge retentive surface which is usually a photoreceptor. The toner powder image is then transferred from the photoconductive member to a copy substrate. The toner particles are heated to permanently affix the powder image to the copy substrate.

In order to fix or fuse the toner material onto a support member permanently by heat and pressure, it is necessary to elevate the temperature of the toner material to a point at which constituents of the toner material coalesce and become tacky. This action causes the toner to flow to some extent onto the fibers or pores of the support members or otherwise upon the surfaces thereof. Thereafter, as the toner material cools, solidification of the toner material occurs causing the toner material to be bonded firmly to the support member.

One approach to thermal fusing of toner material images onto the supporting substrate has been to pass the substrate with the unfused toner images thereon between a pair of opposed roller members at least one of which is internally or externally heated. During operation of a fusing system of this type, the support member to which the toner images are electrostatically adhered is moved through the nip formed between the rollers with the toner image contacting the heated fuser roller to thereby effect heating of the toner images within the nip. In a conventional two roll fuser, one of the rolls is typically provided with a layer or layers that are deformable by a harder opposing roller when the two rollers are pressure engaged.

Web fusers are a type of toner image fixing device in which a web is looped around a fuser roller and typically conveyance rollers. A belt could be used in place of the web, where typically a belt is endless forming a loop, while a web has two ends each of which may be connected to a spool. A pressure roller presses a sheet having a toner image onto the fuser roller with the endless belt intervening between the pressure roller and the fuser roller. The fixing temperature for the toner image is controlled on the basis of the temperature of the fuser roller which may be detected by a sensor, such as a sensor in the loop of the belt and in contact with the fuser roller. A nip region is formed on a pressing portion located between the fuser roller and the pressure roller.

The fuser temperature may be varied with the heating device in an attempt to control the gloss level of resultant images. However, the apparatus may use a variety of different media onto which the toner is fused, with the media having different thermal properties. Additionally, any particular type of media may have some thermal properties variability. Therefore, even if an apparatus was to store fuser temperature values corresponding to each of a plurality of desired gloss levels for each of a plurality of media types, there would still be resulting gloss variability due to the fused toner temperature variability.

SUMMARY

According to aspects of the embodiments, there is provided a method of forming images on media in an electrophotographic apparatus, and corresponding electrophotographic apparatus. The method includes measuring a temperature of the media with a sensor after the toner particles have been fused to the media, and controlling a temperature of the heater device with a controller based on the measured temperature of the media, wherein the temperature is controlled to obtain a desired gloss level for subsequent media to be fused.

DETAILED DESCRIPTION

Figure 1:
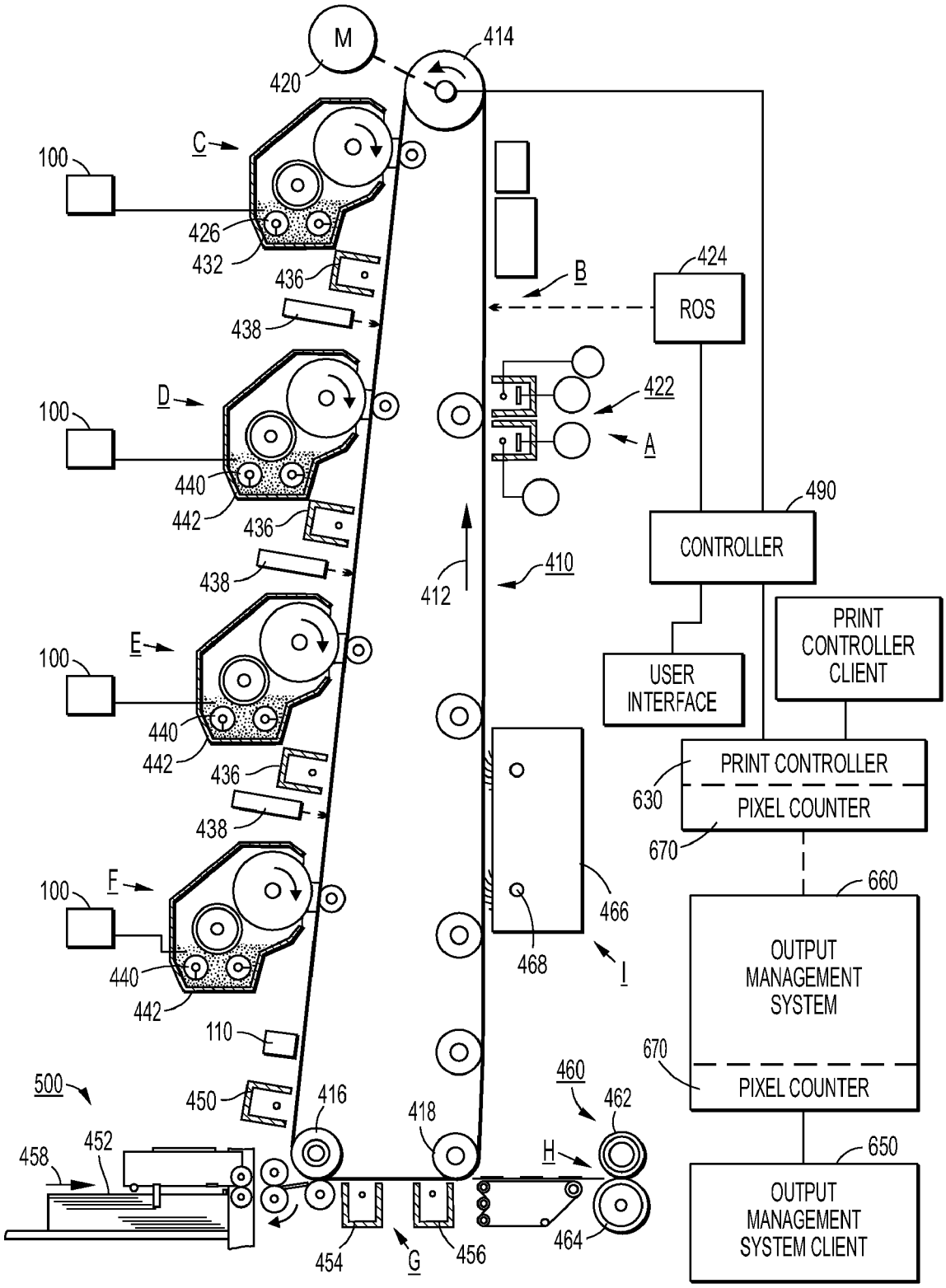
FIG. 1 illustrates a schematic view of a digital imaging system.

While the present invention will be described in connection with preferred embodiments thereof, it will be understood that it is not intended to limit the invention to that embodiment. On the contrary, it is intended to cover all alternatives, modifications and equivalents as may be included within the spirit and scope of the invention as defined by the appended claims.

The disclosed embodiments include a method of forming images on media in an electrophotographic apparatus, the electrophotographic apparatus having a fuser for fusing toner particles to the media to form the images and a heater device for controlling a temperature of the fuser during the fusing. The method includes measuring a temperature of the media with a sensor after the toner particles have been fused to the media, and controlling a temperature of the heater device with a controller based on the measured temperature of the media, wherein the temperature is controlled to obtain a desired gloss level for subsequent media to be fused.

The disclosed embodiments further include an electrophotographic apparatus for forming images on media. The electrophotographic apparatus includes a fuser for fusing toner particles to the media to form the images, a heating device for controlling a temperature of the fuser during the fusing, a sensor positioned for measuring a temperature of the media after the toner particles have been fused to the media, and a controller that receives the measured temperature of the media from the sensor, wherein the controller causes adjustment of a temperature of the heater based on the measured temperature of the media to obtain a desired gloss level for subsequent media to be fused.

The disclosed embodiments further include an electrophotographic apparatus for forming images on media sheets. The electrophotographic apparatus includes a fuser for fusing toner particles to the media sheets to form the images, a heating device for controlling a temperature of the fuser during the fusing, a sensor positioned for measuring a temperature of the media sheets after the toner particles have been fused to the media sheets and outputting a media temperature signal, the sensor also sensing leading and trailing edges of the media sheets and outputting a media edge signal, a signal conditioning circuit receiving the media temperature signal and the media edge signal and outputting a conditioned temperature signal, a controller that receives the conditioned temperature signal, wherein the controller causes adjustment of a temperature of the heater based on the conditioned temperature signal to obtain a desired gloss level for subsequent media to be fused.

In as much as the art of electrophotographic printing is well known, the various processing stations employed in the FIG. 1 printing machine will be shown hereinafter schematically and their operation described briefly with reference thereto. Various other printing machines could also be used, and this is only an example of a particular printing machine that may be used with the invention.

FIG. 1 is a partial schematic view of a digital imaging system, such as the digital imaging system of U.S. Pat. No. 6,505,832, which is hereby incorporated by reference. The imaging system is used to produce an image such as a color image output in a single pass of a photoreceptor belt. It will be understood, however, that it is not intended to limit the invention to the embodiment disclosed. On the contrary, it is intended to cover all alternatives, modifications and equivalents as may be included within the spirit and scope of the invention as defined by the appended claims, including a multiple pass color process system, a single or multiple pass highlight color system, and a black and white printing system.

Referring to FIG. 1, an Output Management System 660 may supply printing jobs to the Print Controller 630. Printing jobs may be submitted from the Output Management System Client 650 to the Output Management System 660. A pixel counter 670 is incorporated into the Output Management System 660 to count the number of pixels to be imaged with toner on each sheet or page of the job, for each color. The pixel count information is stored in the Output Management System memory. The Output Management System 660 submits job control information, including the pixel count data, and the printing job to the Print Controller 630. Job control information, including the pixel count data, and digital image data are communicated from the Print Controller 630 to the Controller 490.

The printing system preferably uses a charge retentive surface in the form of an Active Matrix (AMAT) photoreceptor belt 410 supported for movement in the direction indicated by arrow 412, for advancing sequentially through the various xerographic process stations. The belt is entrained about a drive roller 414, tension roller 416 and fixed roller 418 and the drive roller 414 is operatively connected to a drive motor 420 for effecting movement of the belt through the xerographic stations. A portion of photoreceptor belt 410 passes through charging station A where a corona generating device, indicated generally by the reference numeral 422, charges the photoconductive surface of photoreceptor belt 410 to a relatively high, substantially uniform, preferably negative potential.

Next, the charged portion of photoconductive surface is advanced through an imaging/exposure station B. At imaging/exposure station B, a controller, indicated generally by reference numeral 490, receives the image signals from Print Controller 630 representing the desired output image and processes these signals to convert them to signals transmitted to a laser based output scanning device, which causes the charge retentive surface to be discharged in accordance with the output from the scanning device. Preferably the scanning device is a laser Raster Output Scanner (ROS) 424. Alternatively, the ROS 424 could be replaced by other xerographic exposure devices such as LED arrays.

The photoreceptor belt 410, which is initially charged to a voltage V0, undergoes dark decay to a level equal to about −500 volts. When exposed at the exposure station B, it is discharged to a level equal to about −50 volts. Thus after exposure, the photoreceptor belt 410 contains a monopolar voltage profile of high and low voltages, the former corresponding to charged areas and the latter corresponding to discharged or developed areas.

At a first development station C, developer structure, indicated generally by the reference numeral 432 utilizing a hybrid development system, the developer roller, better known as the donor roller, is powered by two developer fields (potentials across an air gap). The first field is the AC field which is used for toner cloud generation. The second field is the DC developer field which is used to control the amount of developed toner mass on the photoreceptor belt 410. The toner cloud causes charged toner particles to be attracted to the electrostatic latent image. Appropriate developer biasing is accomplished via a power supply. This type of system is a noncontact type in which only toner particles (black, for example) are attracted to the latent image and there is no mechanical contact between the photoreceptor belt 410 and a toner delivery device to disturb a previously developed, but unfixed, image. A toner concentration sensor 200 senses the toner concentration in the developer structure 432.

The developed but unfixed image is then transported past a second charging device 436 where the photoreceptor belt 410 and previously developed toner image areas are recharged to a predetermined level.

A second exposure/imaging is performed by device 438 which comprises a laser based output structure which is utilized for selectively discharging the photoreceptor belt 410 on toned areas and/or bare areas, pursuant to the image to be developed with the second color toner. At this point, the photoreceptor belt 410 contains toned and untoned areas at relatively high voltage levels, and toned and untoned areas at relatively low voltage levels. These low voltage areas represent image areas which are developed using discharged area development (DAD). To this end, a negatively charged, developer material 440 comprising color toner is employed. The toner, which by way of example may be yellow, is contained in a developer housing structure 442 disposed at a second developer station D and is presented to the latent images on the photoreceptor belt 410 by way of a second developer system. A power supply (not shown) serves to electrically bias the developer structure to a level effective to develop the discharged image areas with negatively charged yellow toner particles. Further, a toner concentration sensor 200 senses the toner concentration in the developer housing structure 442.

The above procedure is repeated for a third image for a third suitable color toner such as magenta (station E) and for a fourth image and suitable color toner such as cyan (station F). The exposure control scheme described below may be utilized for these subsequent imaging steps. In this manner a full color composite toner image is developed on the photoreceptor belt 410. In addition, a mass sensor 110 measures developed mass per unit area. Although only one mass sensor 110 is shown in FIG. 1, there may be more than one mass sensor 110.

To the extent to which some toner charge is totally neutralized, or the polarity reversed, thereby causing the composite image developed on the photoreceptor belt 410 to consist of both positive and negative toner, a negative pre-transfer dicorotron member 450 is provided to condition the toner for effective transfer to a substrate using positive corona discharge.

Subsequent to image development a sheet of support material 452 is moved into contact with the toner images at transfer station G. The sheet of support material 452 is advanced to transfer station G by a sheet feeding apparatus 500, described in detail below. The sheet of support material 452 is then brought into contact with photoconductive surface of photoreceptor belt 410 in a timed sequence so that the toner powder image developed thereon contacts the advancing sheet of support material 452 at transfer station G.

Transfer station G includes a transfer dicorotron 454 which sprays positive ions onto the backside of sheet 452. This attracts the negatively charged toner powder images from the photoreceptor belt 410 to sheet 452. A detack dicorotron 456 is provided for facilitating stripping of the sheets from the photoreceptor belt 410.

After transfer, the sheet of support material 452 continues to move, in the direction of arrow 458, onto a conveyor 600 which advances the sheet to fusing station H. Fusing station H includes a fuser assembly, indicated generally by the reference numeral 460, which permanently affixes the transferred powder image to sheet 452. Preferably, fuser assembly 460 comprises a heated fuser roller 462 and a backup or pressure roller 464. Sheet 452 passes between fuser roller 462 and pressure roller 464 with the toner powder image contacting fuser roller 462. In this manner, the toner powder images are permanently affixed to sheet 452. After fusing, a chute, not shown, guides the advancing sheet 452 to a catch tray, stacker, finisher or other output device (not shown), for subsequent removal from the printing machine by the operator. The fuser assembly 460 may be contained within a cassette, and may include additional elements not shown in this figure, such as an endless fuser belt or fuser web around the fuser roller 462. In typical printing machines, this belt or web has been kept relatively short to minimize the size of the fuser assembly or cassette.

After the sheet of support material 452 is separated from photoconductive surface of photoreceptor belt 410, the residual toner particles carried by the non-image areas on the photoconductive surface are removed therefrom. These particles are removed at cleaning station I using a cleaning brush or plural brush structure contained in a housing 466. The cleaning brushes 468 are engaged after the composite toner image is transferred to a sheet.

Controller 490 regulates the various printer functions. The controller 490 is preferably a programmable controller, which controls printer functions hereinbefore described. The controller 490 may provide a comparison count of the copy sheets, the number of documents being recirculated, the number of copy sheets selected by the operator, time delays, jam corrections, etc. The control of all of the exemplary systems heretofore described may be accomplished by conventional control switch inputs from the printing machine consoles selected by an operator. Conventional sheet path sensors or switches may be utilized to keep track of the position of the document and the copy sheets.

The foregoing description illustrates the general operation of an electrophotographic printing machine incorporating the development apparatus of the present disclosure therein. Not all of the elements discussed in conjunction with FIG. 1 are necessarily needed for effective use of the invention. Instead, these elements are described as a machine within which embodiments of the invention could operate.

Figure 2:
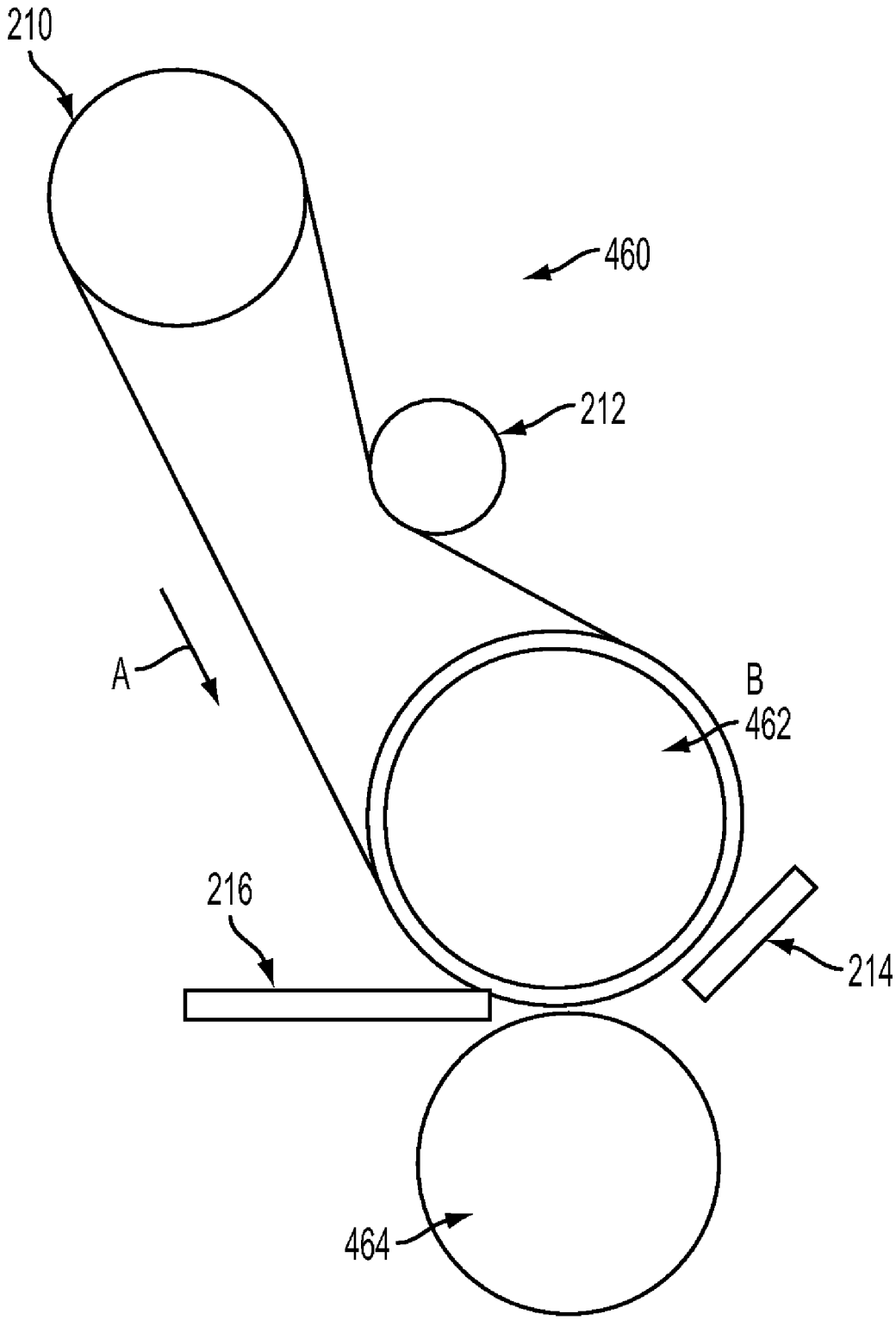
FIG. 2 illustrates a diagram of a fuser assembly.

FIG. 2 illustrates the fuser assembly 460 in greater detail. The fuser assembly 460 includes the fuser roller 462, the pressure roller 464, fuser belt 210, rollers 212, and sensor 214. The fuser roller 462 may include a heater device to heat the fuser roller 462, although any other heater device may be used to heat the fusing process, such as a heater in the fuser belt 210, or elsewhere. The fuser belt 210 may be driven by a motor (not shown) such as a stepper motor, for example, to move in the direction of arrow A. Media sheet 216 may come into contact with fuser belt 210 at a nip of the fuser assembly 460 to accomplish the fusing process. The fuser belt 210 may be replaced by a fuser web.

The sensor 214 is used to sense temperature of the media sheet 216 after it leaves the nip of the fuser assembly 460. The sensor may also sense leading and trailing edges of the media sheet 216 so that the temperature measurements are not made between media sheets 216. The sensor 214 may be a contactless sensor.

Figure 3:
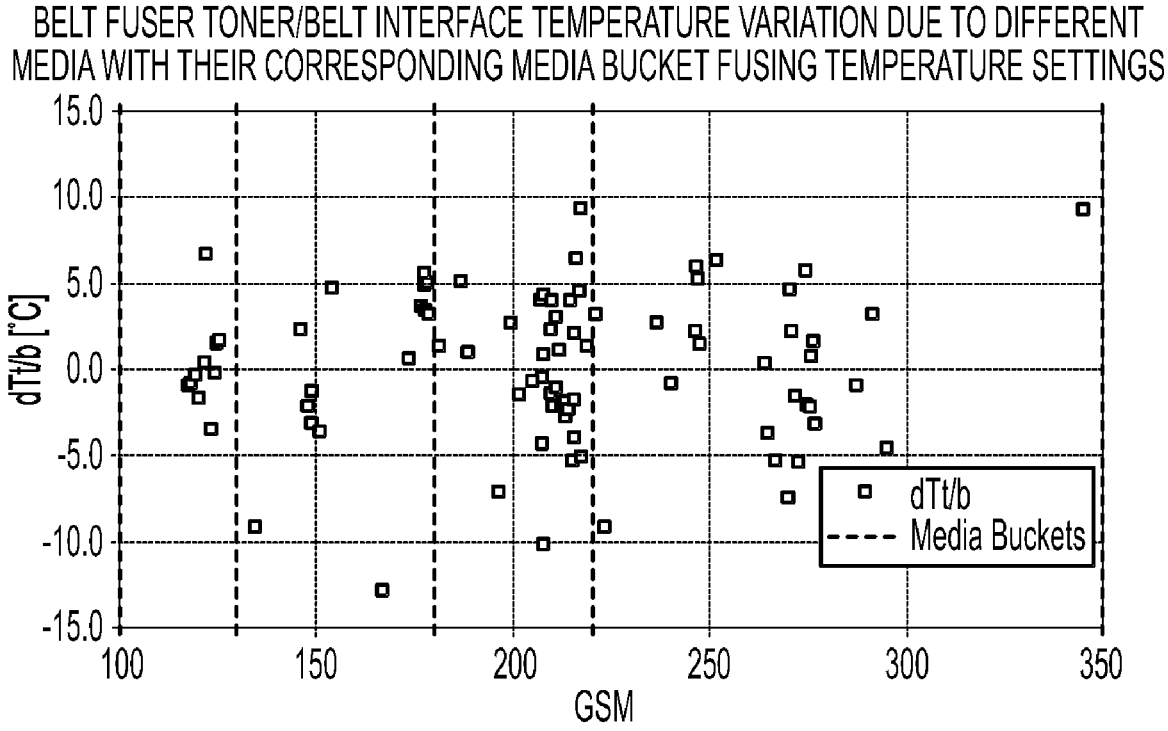
FIG. 3 illustrates a graph of media weight versus change in temperature at a fuser nip.

FIG. 3 illustrates a graph of media weight in grams per square meter (gsm) versus change in temperature at the nip due to different media. Fuser temperature setpoints can be defined by media weight range, but that does not assure that the toner will reach the same fusing temperature. In FIG. 3, four different fusing temperature setpoints were used for coated media ranging from 100 gsm to 350 gsm. The gsm ranges used were 100-130 gsm, 130-180 gsm, 180-220 gsm and 220-350 gsm, each with its own fuser setpoint temperature. The variation in temperature at the nip (toner belt interface) was about +/−10 degrees C. due to the different media thermal properties, resulting in non-uniform gloss levels.

Figure 4A:
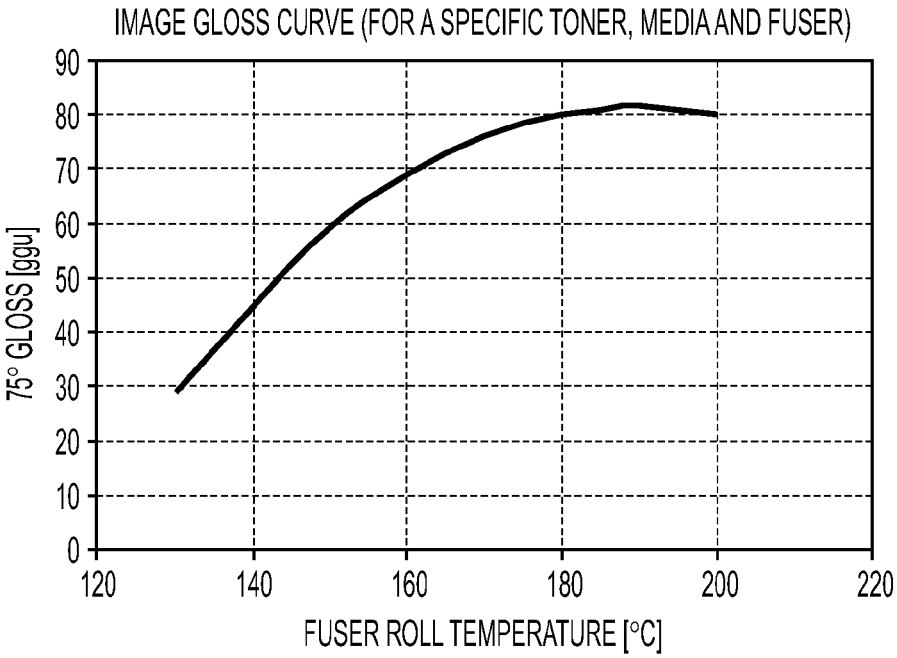
FIG. 4A illustrates a graph of a toner gloss curve.
Figure 4B:
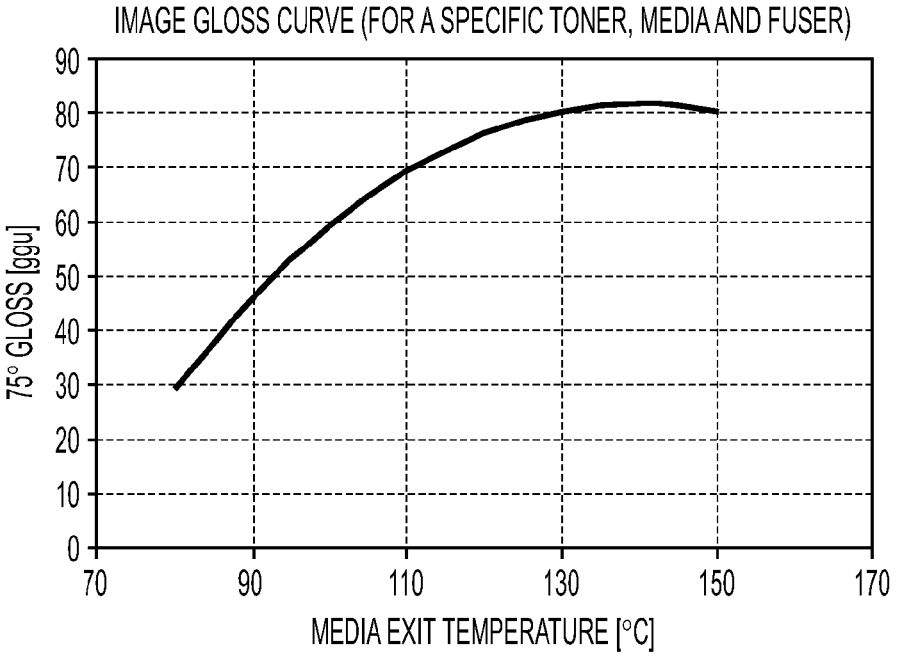
FIG. 4B illustrates a graph of a toner gloss curve.
Figure 5:
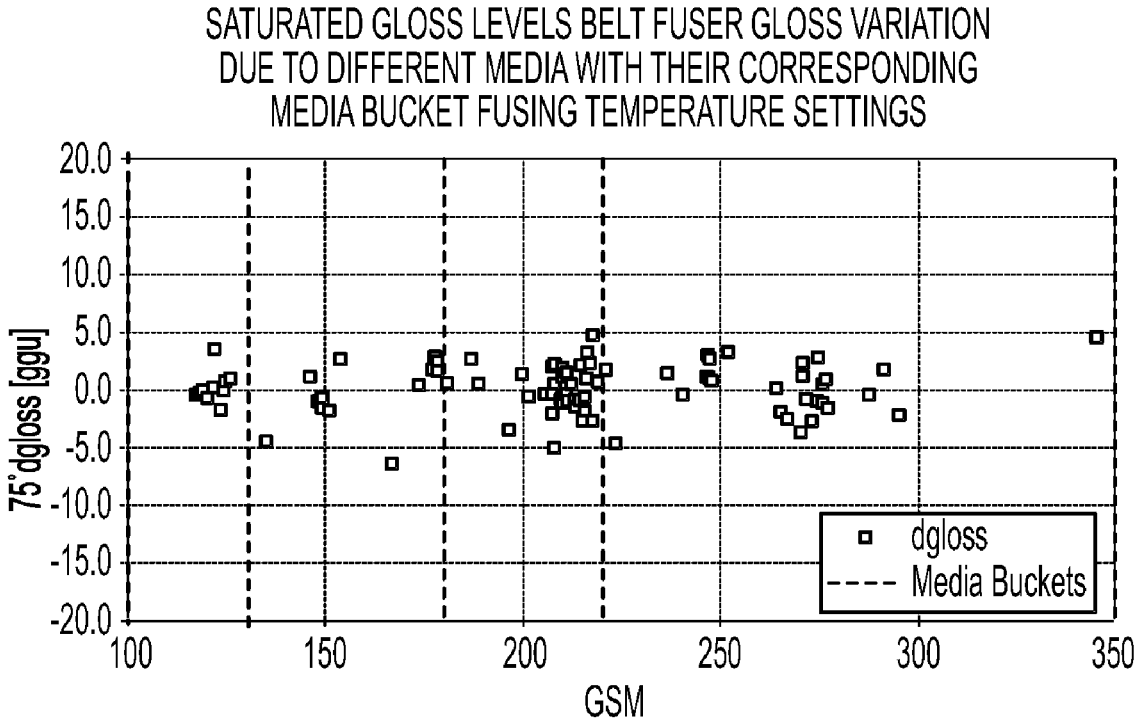
FIG. 5 illustrates a graph of media induced gloss variability.

In order to achieve more uniform gloss levels within a given media gsm range, fusing temperatures close to the gloss saturation limits can be used. In FIG. 4A, a typical toner gloss curve is shown which has saturated gloss for FR temperatures above about 180 degrees C. In FIG. 4B, a typical toner gloss curve is shown which has saturated gloss for media exit temperatures above about 130 degrees C. Even if a single high gloss level is acceptable to a user, there will still be a media induced gloss variability of about +/−5 ggu (75 degrees Gardiner gloss units), as may be seen in FIG. 5.

Figure 6:
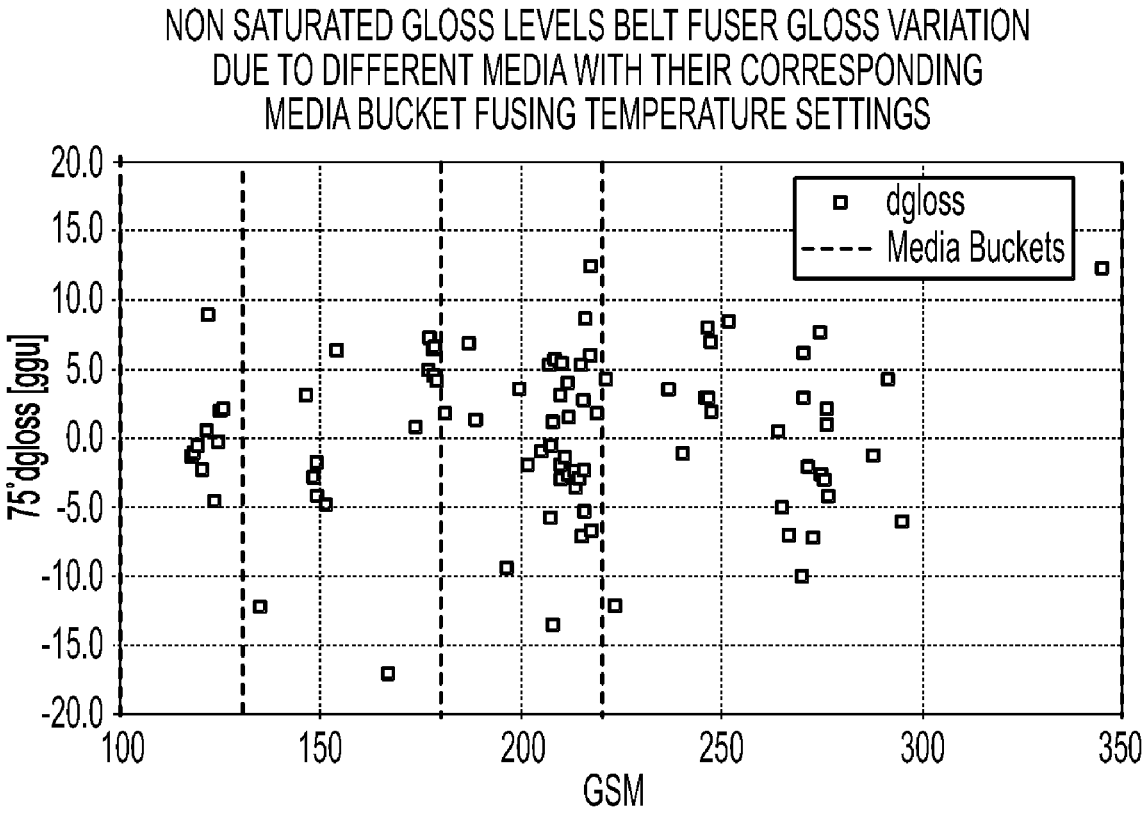
FIG. 6 illustrates a graph of media induced gloss variability.

However, if a user wants a gloss level below saturation limits, the user could have a media induced gloss variability of +/−15 ggu, as shown in FIG. 6. This gloss variability could be even larger when taking into account other sources such as toner properties.

Figure 7:
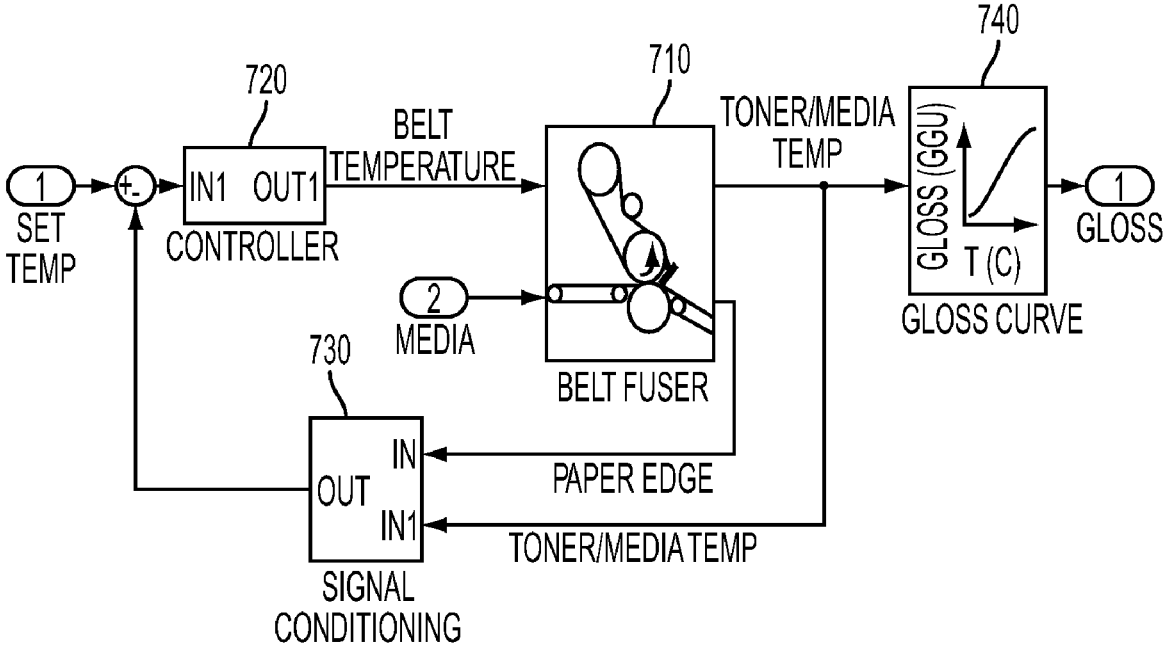
FIG. 7 illustrates a temperature feedback control circuit.

Accordingly, embodiments of the invention measure a temperature of the media immediately upon leaving the nip and employ temperature feedback control of the fuser to achieve desired gloss levels. Embodiments may use a configuration such as shown in FIG. 7 to employ the temperature feedback control. The media temperature is measured at the fuser assembly 710, which is fed to a signal conditioning circuit 730, along with a media edge signal. The media edge signal is used so that any temperatures measured between media sheets are not used. The media temperature signal may be a signal for one media sheet or for a plurality of media sheets.

A plurality of gloss curves 740 for different media types are used by the controller 720 to look up a toner/media temperature for a desired gloss level. These gloss curves have been previously stored in memory and come from a series of tests performed on representative media within the weight range and coating classification. These values are stored in memory and looked up by the controller 720 as needed. The controller 720 then compares the toner/media temperature to the conditioned temperature from the signal conditioning circuit 730 and raises or lowers the temperature of the fuser accordingly to achieve the desired toner/media temperature corresponding to a desired gloss level. This process continues for any number of media sheets. By using this temperature feedback control, a desired gloss level may be achieved regardless of variations in media and toner thermal properties or other factors that may affect temperature at the nip of the fuser assembly. If the desired gloss level is changed, the controller 720 will look up the new desired gloss level and compare the new toner/media temperature to the conditioned temperature signal and adjust the temperature of the heater device accordingly.

When the user uses a media that is not included in the media database an alternative media will be recommended. The user will chose a gloss setting and can then measure the gloss off-line. If the gloss level is higher or lower than desired then he has the alternative of lowering or increasing the gloss level until it matches its desired setting. After the desired setting is achieved the user will be able to include the new media gloss curve into the machine database. This can be achieved by either a repetitive process which could mean several runs or a single automated run with different temperature levels. After this the user can measure the gloss level offline and input the new media gloss curve into the machine database.

Current non-contact temperature sensors are not fast enough to output the temperature of the media exiting the fuser nip without a transient in the order of the media dwell time. The temperature sensor transient requires at least half the media dwell time to be close to steady-state. Because of this deconvolution of the signal will be required. Deconvolution of the temperature sensor output signal will uncover the media temperature before it got low-pass filtered by the non-contact temperature sensor.

Figure 8:
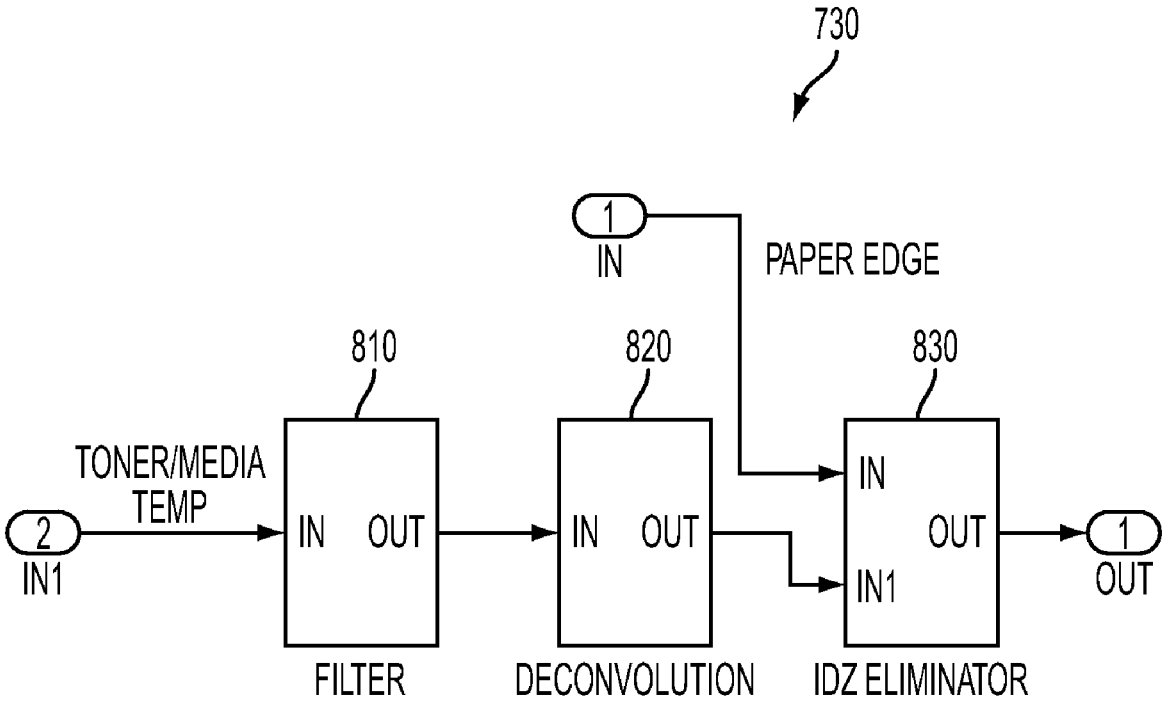
FIG. 8 illustrates a signal conditioning circuit.
Figure 9A:
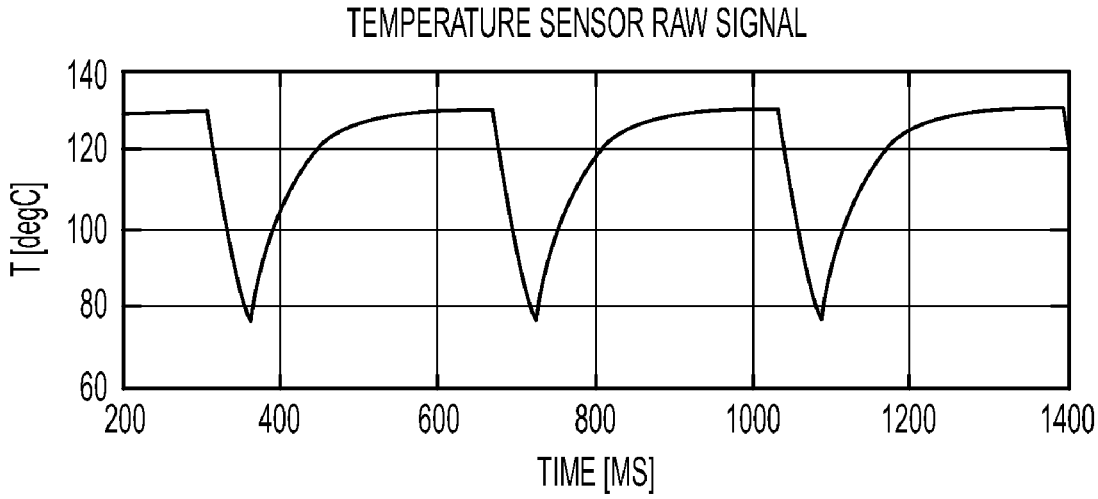
FIG. 9A illustrates a graph of a raw temperature signal.
Figure 9B:
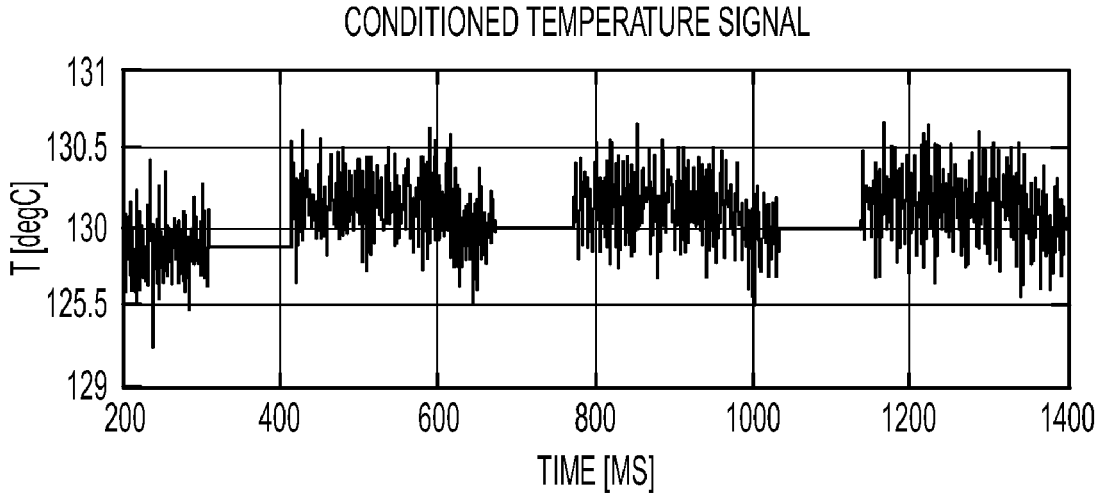
FIG. 9B illustrates a graph of a conditioned temperature signal.

FIG. 8 illustrates the signal conditioning circuit 730 in further detail. The media temperature is fed to a filter 810 to filter the signal, after which it is deconvoluted by deconvolution element 820. The deconvolution element has knowledge of the low-pass filtering properties of the non-contact temperature sensor. After the signal has been deconvoluted, it then proceeds to IDZ (inter document zone) eliminator 830 along with the media edge signal, to produce a conditioned temperature signal. The raw temperature signal and the conditioned temperature signal are illustrated in FIG. 9A and FIG. 9B, respectively. The raw temperature signal includes a number of valleys corresponding to the signal as measured between media sheets. In the conditioned temperature signal, the valleys are removed.

Figure 10:
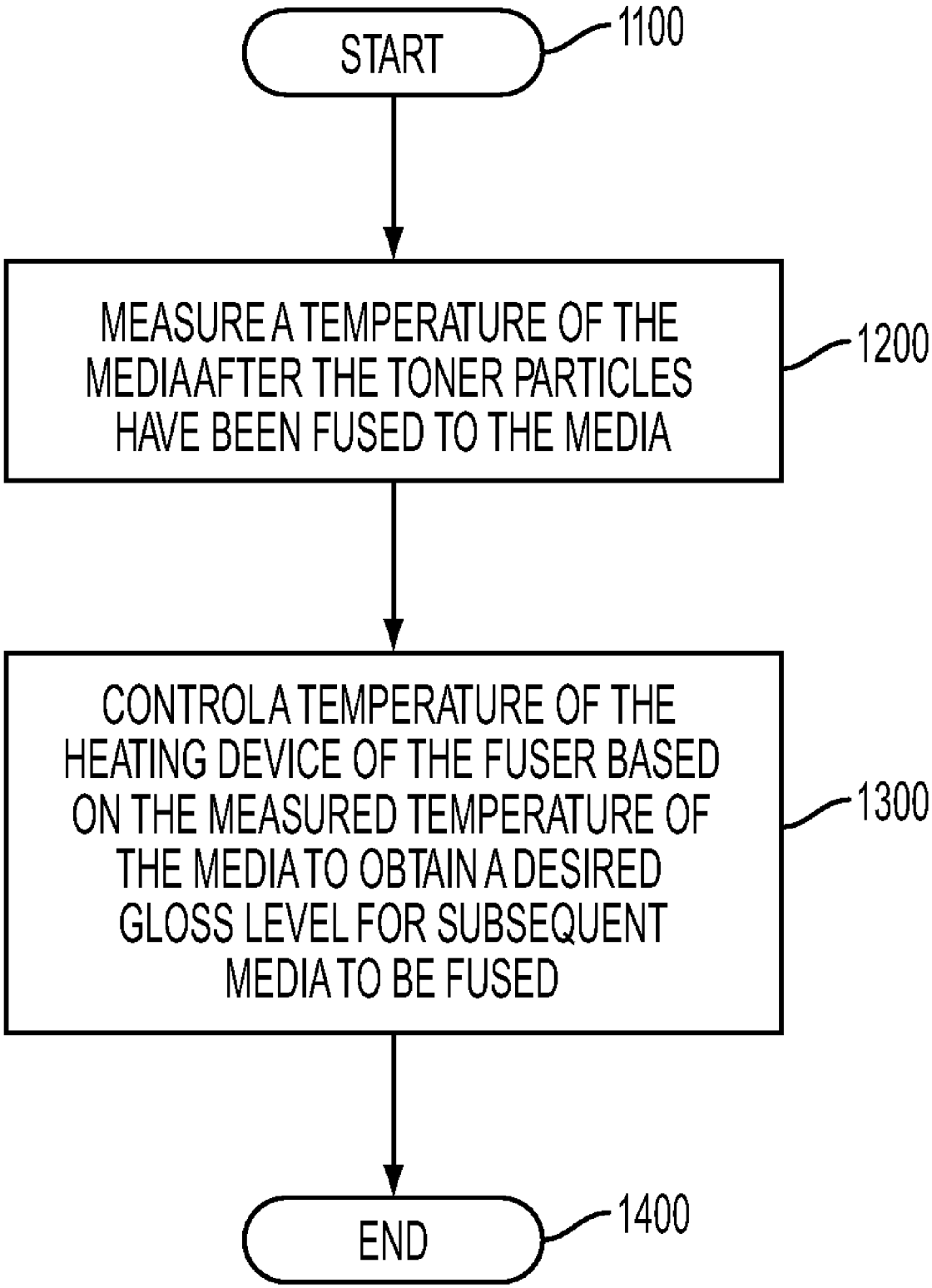
FIG. 10 illustrates a flowchart of a method of forming images on media in an electrophotographic apparatus.

FIG. 10 illustrates a flowchart of a method of forming images on media in an electrophotographic apparatus, the electrophotographic apparatus having a fuser for fusing toner particles to the media to form the images and a heater device for controlling a temperature of the fuser during the fusing. In 1200, a temperature of the media is measured with a sensor after the toner particles have been fused to the media.

In 1300, a temperature of the heater device is controlled with a controller based on the measured temperature of the media, wherein the temperature is controlled to obtain a desired gloss level for subsequent media to be fused. In 1400, the method ends.

Embodiments as disclosed herein may include computer-readable medium for carrying or having computer-executable instructions or data structures stored thereon. Such computer-readable medium can be any available medium that can be accessed by a general purpose or special purpose computer. By way of example, and not limitation, such computer-readable medium can comprise RAM, ROM, EEPROM, CD-ROM or other optical disk storage, magnetic disk storage or other magnetic storage devices, or any other medium which can be used to carry or store desired program code means in the form of computer-executable instructions or data structures. When information is transferred or provided over a network or another communications connection (either hard-wired, wireless, or combination thereof to a computer, the computer properly views the connection as a computer-readable medium. Thus, any such connection is properly termed a computer-readable medium. Combinations of the above should also be included within the scope of the computer-readable medium.

Computer-executable instructions include, for example, instructions and data which cause a general purpose computer, special purpose computer, or special purpose processing device to perform a certain function or group of functions. Computer-executable instructions also include program modules that are executed by computers in stand-alone or network environments. Generally, program modules include routines, programs, objects, components, and data structures, and the like that perform particular tasks or implement particular abstract data types. Computer-executable instructions, associated data structures, and program modules represent examples of the program code means for executing steps of the methods disclosed herein. The particular sequence of such executable instructions or associated data structures represents examples of corresponding acts for implementing the functions described therein. The instructions for carrying out the functionality of the disclosed embodiments may be stored on such a computer-readable medium.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A method of forming images on media in an electrophotographic apparatus, the electrophotographic apparatus having a fuser for fusing toner particles to the media to form the images and having a heater device for controlling a temperature of the fuser during the fusing, comprising:

measuring a temperature of the media with a sensor after the toner particles have been fused to the media; and controlling a temperature of the heater device with a controller based on the measured temperature of the media, wherein the temperature is controlled to obtain a desired gloss level for subsequent media to be fused.

2. The method of claim 1, wherein the sensor is positioned adjacent to a nip of the fuser.

3. The method of claim 1, wherein controlling the temperature of the heater device comprises employing feedback control of the temperature of the heater device based on the measured temperature of the media.

4. The method of claim 1, wherein controlling the temperature of the heater device comprises comparing the measured temperature of the media to a stored temperature corresponding to the desired gloss level, and adjusting a temperature of the heater device based on the comparison.

5. The method of claim 4, wherein controlling the temperature of the heater device further comprises measuring a leading edge and a trailing edge of the media with the sensor.

6. The method of claim 4, further comprising storing a plurality of temperature values, each of the temperature values corresponding to a desired gloss level.

7. The method of claim 1, further comprising changing a temperature of the heater device based on a change in the desired gloss level.

8. An electrophotographic apparatus for forming images on media, comprising:

a fuser for fusing toner particles to the media to form the images;

a heater device for controlling a temperature of the fuser during the fusing;

a sensor positioned for measuring a temperature of the media after the toner particles have been fused to the media; and a controller that receives the measured temperature of the media from the sensor, wherein the controller causes adjustment of a temperature of the heater based on the measured temperature of the media to obtain a desired gloss level for subsequent media to be fused.

9. The electrophotographic apparatus of claim 8, wherein the sensor is positioned adjacent to a nip of the fuser.

10. The electrophotographic apparatus of claim 8, wherein the controller controls the temperature of the heater device by comparing the measured temperature of the media to a stored temperature corresponding to the desired gloss level, and adjusting a temperature of the heater device based on the comparison.

11. The electrophotographic apparatus of claim 8, wherein the sensor senses a leading edge and a trailing edge of the media, and outputs a media edge signal.

12. The electrophotographic apparatus of claim 11, further comprising a signal conditioning circuit receiving the media temperature signal and the media edge signal, and outputs a conditioned temperature signal to the controller.

13. The electrophotographic apparatus of claim 12, wherein the media temperature signal comprises a temperature from a plurality of media sheets.

14. The electrophotographic apparatus of claim 12, wherein the controller changes a temperature of the heater device based on a change in the desired gloss level.

15. An electrophotographic apparatus for forming images on media sheets, comprising:

a fuser for fusing toner particles to the media sheets to form the images;

a heater device for controlling a temperature of the fuser during the fusing;

a sensor positioned for measuring a temperature of the media sheets after the toner particles have been fused to the media sheets and outputting a media temperature signal, the sensor also sensing leading and trailing edges of the media sheets and outputting a media edge signal;

a signal conditioning circuit receiving the media temperature signal and the media edge signal and outputting a conditioned temperature signal; and a controller that receives the conditioned temperature signal, wherein the controller causes adjustment of a temperature of the heater device based on the conditioned temperature signal to obtain a desired gloss level for subsequent media to be fused.

16. The electrophotographic apparatus of claim 15, wherein the sensor is positioned adjacent to a nip of the fuser.

17. The electrophotographic apparatus of claim 15, wherein the controller controls the temperature of the heater device by comparing the measured conditioned temperature signal to a stored temperature corresponding to the desired gloss level, and adjusting a temperature of the heater device based on the comparison.

18. The electrophotographic apparatus of claim 15, wherein the controller changes a temperature of the heater device based on a change in the desired gloss level.

* * * * *